US006263717B1

(12) United States Patent
Nojiri

(10) Patent No.: US 6,263,717 B1
(45) Date of Patent: Jul. 24, 2001

(54) PRESS-FORMING DIE SET INCLUDING ROTARY CAM HAVING NEGATIVE-ANGLE FORMING PORTION AND ROTATABLE ABOUT VERTICAL AXIS

(75) Inventor: Isao Nojiri, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/597,228

(22) Filed: Jun. 20, 2000

(30) Foreign Application Priority Data

Jul. 5, 1999 (JP) ..... 11-190277

(51) Int. Cl.[7] ..... B21D 5/04

(52) U.S. Cl. ..... 72/313; 72/315; 72/383; 72/400; 72/452.7

(58) Field of Search ..... 72/315, 381, 383, 72/394, 400, 379.2, 452.7, 399, 313

(56) References Cited

U.S. PATENT DOCUMENTS

| | | | | |
|---|---|---|---|---|
| 2,286,255 | * | 6/1942 | Brooks | 72/383 |
| 2,321,951 | * | 6/1943 | Susskind | 72/383 |
| 5,347,838 | * | 9/1994 | Matsuoka | 72/313 |
| 5,746,082 | * | 5/1998 | Matsuoka | 72/313 |
| 5,784,916 | * | 7/1998 | Matsuoka | 72/313 |

FOREIGN PATENT DOCUMENTS

| | | | | |
|---|---|---|---|---|
| 113930 | * | 6/1984 | (JP) | 72/383 |
| 60-166122 | | 8/1985 | (JP) . | |
| 66414 | * | 3/1991 | (JP) | 72/383 |
| 10-192982 | | 7/1998 | (JP) . | |
| 1532142 | * | 12/1989 | (SU) | 72/383 |

* cited by examiner

*Primary Examiner*—Daniel C. Crane
(74) *Attorney, Agent, or Firm*—Burns, Doane, Swecker & Mathis, LLP

(57) ABSTRACT

A press-forming die set including a first die and a second die which are linearly movable in a press-forming direction for mutual engagement to form a negative-angle portion on a workpiece placed on the second die, the press-forming die further including a rotary cam having a first negative-angle forming portion, and a forming cam having a second negative-angle forming portion. The first negative-angle forming portion is disposed such that the rotary cam is rotatable about an axis of rotation inclined with respect to a bottom surface of the workpiece. The rotary cam is engageable with the second die and is rotated about the axis of rotation in one of opposite directions when the first and second dies are moved toward each other, and is rotated in the other direction when the first and second dies are moved away from each other. The forming cam is held in engagement with the first negative-angle forming portion while the first and second dies are held in engagement with each other, and is disengaged from the first negative-angle forming portion when the first and second dies are spaced apart from each other.

9 Claims, 5 Drawing Sheets

PRESS-FORMING DIE SET INCLUDING ROTARY CAM HAVING NEGATIVE-ANGLE FORMING PORTION AND ROTATABLE ABOUT VERTICAL AXIS

This application is based on Japanese Patent Application No. 11-190277 filed Jul. 5, 1999, the contents of which are incorporated hereinto by reference.

BACKGROUND OF THE INVENTION

1. Field of the Invention

The present invention relates to a press-forming die set adapted to perform a pressing operation on a workpiece in the form of a thin sheet, so as to form a negative-angle portion on the workpiece. The press-forming die set includes a first die (e.g., an upper die and a second die (e.g., a lower die), which are moved toward and away from each other in a press-forming direction, usually, in the vertical direction. The workpiece is placed on the second die such that the inner surface of the workpiece is held in contact with the second die. This inner surface of the workpiece is referred to as "inner mounting surface". In the present application, the term "negative-angle portion" is interpreted to mean a portion of the press-formed workpiece which portion is bent with respect to the above-indicated press-forming direction such that the bent portion in question of the workpiece is inclined with respect to the press-forming direction, so as to generally extend under the inner mounting surface of the press-formed workpiece.

2. Discussion of Related Art

To form such a negative-angle portion on a thin sheet such as a thin metal or plastic sheet, there has been conventionally used a press-forming die set which includes a linear slide cam or a rotary cam. Where the linear slide cam is used to form the negative-angle portion, the linear slide cam is incorporated in a side guide cam provided on the lower die, and the upper die is vertically moved down toward the lower die on which the workpiece is placed, so that a downward movement of a cam fixed on the upper die causes a movement of the linear slide cam in the horizontal direction so as to bend a portion of the workpiece, for forming the negative-angle portion. After the formation of the negative-angle portion, the linear slide cam is moved away from the workpiece in a direction parallel to the surface of the formed negative-angle portion, which generally extends under the inner mounting surface of the workpiece. Thus, the negative-angle portion can be easily formed using the linear slide cam.

Where the negative-angle portion is formed on the workpiece by a press-forming die set including the linear slide cam, as described above, the linear slide cam is required to be moved in the direction parallel to the surface of the formed negative-angle portion, in order to remove the formed workpiece (product) from the die set. However, the negative-angle portion cannot be formed by the die set including the linear slide cam, where the width of the product obtained by press-forming the workpiece is relatively small, since the linear slide cam cannot be moved in the direction parallel to the formed negative-angle portion.

In a known press-forming die set including a rotary cam to form the negative-angle portion, on the other hand, the rotary cam having a negative-angle forming portion is incorporated in the lower die or in the side guide cam provided on the lower die, such that the rotary cam is rotatable about an axis parallel to the bottom surface of the lower die which is perpendicular to the press-forming direction. An example of such a press-forming die set is disclosed in JP-A-60-166122. Another example of such a known press-forming die including a rotary cam is shown in FIG. 6, which does not show an upper die and a lower die. In this die set, a workpiece 100 is placed on a guide cam 102 provided on the lower die, so that an inner mounting surface 104 of the workpiece 100 is held in contact with the upper surface of the guide cam 102, such that the inner mounting surface 104 is parallel to the bottom surface of the lower die. The upper die is adapted to be lowered toward the lower die in a direction perpendicular to the inner mounting surface 104. To bend the workpiece 100 so as to form a negative-angle portion 112, the rotary cam 106 is rotated in the clockwise direction "a" indicated in FIG. 6, so that a negative-angle forming portion 108 of the rotary cam 106 is moved toward a negative-angle forming portion 110 provided on the upper die, whereby the negative-angle forming portions 108 and 110 cooperate to form the negative angle portion 112 on the workpiece 100. After the formation of the negative-angle portion 112, the rotary cam 106 is rotated in the counterclockwise direction so that the negative-angle forming portion 108 is moved away from the negative-angle portion 112. In this case, therefore, the negative-angle portion 112 can be formed even where the width of the formed product having the negative-angle portion 112 is comparatively small, provided that the diameter of the rotary cam 106 can be made relatively small.

Where the negative-angle portion 112 is formed by the die set including the conventional rotary cam 106, this rotary cam 106 is required to be rotated so as to prevent an interference of its negative-angle forming portion 112 with the negative-angle portion 112 of the press-formed workpiece 100 (i.e., product), when the product is removed from the die set. For removing the product from the die set so as to prevent the interference, the angle of the movement path of the negative-angle forming portion 108 of the rotary cam 106 with respect to the inner mounting surface 104 of the workpiece 100 should decrease as the negative angle of the negative-angle portion 112 with respect to the pressforming direction increases. That is, when the negative-angle portion 112 generally extends almost parallel to the inner mounting surface 104, the negative-angle forming portion 108 is required to be moved away from the negative-angle portion 112 (negative-angle forming portion 110) in a direction almost parallel to the inner mounting surface 104 of the press-formed workpiece 100.

The angle of the movement path of the negative-angle forming portion 108 of the rotary cam 106 with respect to the inner mounting surface 104 decreases with an increase in the diameter of the rotary cam 106. Therefore, the diameter of the rotary cam 106 should increase with an increase in the negative angle of the negative-angle portion 112 with respect to the pressforming direction. However, it is difficult to incorporate the rotary cam 106 in the guide cam 102 where the diameter of the rotary cam 106 is relatively large. Further, a dimension "b" of the product (press-formed workpiece 100) decreases with an increase in the diameter of the rotary cam 106, so that the strength of the guide cam 102 decreases with an increase in the diameter of the rotary cam 106. Accordingly, the strength of the guide cam 102 is not sufficient when the width dimension of the product is comparatively small. Where the negative angle of the negative-angle portion 112 is excessively large, for instance, where the negative-angle portion 112 is almost parallel to the inner mounting surface 104, that is, almost perpendicular to the press-forming direction, the negative-angle forming portion 108 of the rotary cam 106 interferes with the inner mounting surface 104, namely, the path of movement of the negative-angle forming portion 108 intersects the inner mounting surface 104. In this instance, therefore, the rotary cam 106 cannot be rotated, unless the configuration of the product to be manufactured is suitably changed.

SUMMARY OF THE INVENTION

It is therefore an object of the present invention to provide a press-forming die set which permits a press-forming operation on a workpiece so as to form a negative-angle portion, even where the product to be manufactured by press-forming the workpiece has a relatively small width dimension and where the negative-angle portion has a comparatively large negative angle with respect to the press-forming direction.

Extensive researches and studies by the present inventor revealed that the problems experienced in the prior art described above could be solved by providing the lower die of the press-forming die set with a rotary cam such that the rotary cam is rotatable about an axis that intersects the bottom surface of the lower die, rather than about an axis that is parallel to the bottom surface as in the prior art die set. That is, the angle of the plane of rotation of the rotary cam with respect to the inner mounting surface of the workpiece decreases with an increase in the angle of inclination of the axis of rotation of the rotary cam with respect to the bottom surface of the lower die, namely, decreases with a decrease in the angle of inclination of the rotation axis of the rotary cam with respect to the press-forming direction. The plane of rotation of the rotary cam is perpendicular of its axis of rotation. Accordingly, a possibility of interference of the rotary cam with the inner mounting surface of the workpiece is reduced with an increase in the angle of inclination of the rotation axis of the rotary cam with respect to the bottom surface of the lower die. Further, the need for increasing the diameter of the rotary cam to avoid the interference of the negative-angle forming portion of the rotary cam with the negative-angle portion formed on the workpiece is reduced with an increase in the inclination angle of the rotation axis of the rotary cam with respect to the bottom surface of the lower die, where the negative angle of the negative-angle portion is comparatively large. When the angle of inclination of the rotation axis of the rotary cam with respect to the bottom surface of the lower die is 90°, that is, when the rotation axis is parallel to the press-forming direction, the plane of rotation of the rotary cam is parallel to the inner mounting surface of the workpiece, so that the rotary cam can be rotated without an interference with the inner mounting surface of the workpiece and the formed negative-angle portion, even where the negative-angle portion generally extends in the direction parallel to the inner mounting surface. The present invention is based on the inventor's finding described above.

That is, the object of the present invention indicated above may be achieved according to the principle of this invention, which provides a press-forming die set including a first die and a second die which are linearly movable toward each other in a predetermined press-forming direction, for engagement with each other to form a negative-angle portion on a workpiece placed on the second die, the die set comprising: (a) a rotary cam including a first negative-angle forming portion and disposed such that the rotary cam is rotatable about an axis of rotation inclined with respect to a bottom surface of the second die, the rotary cam being engageable with the second die and rotated about the axis of rotation in one of opposite directions when the first and second dies are moved toward each other in the press-forming direction, the rotary cam being rotated in the other of the opposite directions when the first and second dies are moved away from each other; and (b) a forming cam including a second negative-angle forming portion which is held in engagement with the first negative-angle forming portion of the rotary cam while the first and second dies are held in engagement with each other, and which is disengaged from the first negative-angle forming portion when the first and second dies are spaced apart from each other.

In the press-forming die set of the present invention wherein the axis of rotation of the rotary cam is inclined with respect to the bottom surface of the second die, as described above, there is a reduced possibility of interference of the first negative-angle forming portion of the rotary cam with the inner mounting surface of the workpiece when the rotary cam is rotated in the above-indicated other direction after the negative-angle portion is formed on the workpiece by the mutual engagement of the first and second negative-angle forming portions of the rotary cam and the forming cam, as compared with that in the conventional press-forming die set wherein the axis of rotation of the rotary cam is parallel to the bottom surface of the second die. Further, the present arrangement eliminates a need of increasing the diameter of the rotary cam in order to prevent the interference of the first negative-angle forming portion of the rotary cam with the formed negative-angle portion. Accordingly, the negative-angle portion can be formed by the present die set, even where the width dimension of the product produced by press-forming the workpiece is comparatively small and even where the negative angle of the negative-angle portion is comparatively large.

In one preferred form of the present invention, the die set further comprises a rotary shaft provided on the second die such that an axis of rotation of the rotary shaft is inclined with respect to the bottom surface of the second die, and the rotary cam is rotatable about the axis of rotation of the rotary shaft.

In another preferred form of the invention, the axis of rotation of the rotary shaft is inclined by an angle of at least 30° with respect to the bottom surface of the second die. In this arrangement, the dimension of the upper surface of the rotary cam in the direction perpendicular to the bottom surface of the second die, i.e., in the press-forming direction is reduced to $\sqrt{3}/2$ or smaller of the dimension of a rotary cam whose axis of rotation is parallel to the bottom surface of the second die and which has the same diameter of the present rotary cam. Accordingly, the possibility of interference of the negative-angle forming portion of the rotary cam with the inner mounting surface of the workpiece is reduced. Further, the possibility of interference of the negative-angle forming portion of the rotary cam with the negative-angle portion formed on the workpiece is also accordingly reduced, and the need of increasing the diameter of the rotary cam is accordingly reduced.

In an advantageous arrangement of the above preferred form of the invention, the axis of rotation of the rotary shaft is inclined by an angle of at least 60° with respect to the bottom surface of the second die. In this arrangement, the dimension of the upper surface of the rotary cam in the press-forming direction is reduced to ½ or smaller of the dimension of the rotary cam whose axis of rotation is parallel to the bottom surface of the second die and which has the same diameter of the present rotary cam. Accordingly, the possibility of interference of the negative-angle forming portion of the rotary cam with the inner mounting surface of the workpiece is further reduced, and the possibility of interference of the negative-angle forming portion of the rotary cam with the negative-angle portion formed on the workpiece is further accordingly reduced, so that the need of increasing the diameter of the rotary cam is accordingly reduced.

Preferably, the axis of rotation of the rotary cam is inclined by an angle of at least 90° with respect to the bottom surface of the second die. In this arrangement, the upper surface of the rotary cam parallel with the inner mounting surface of the workpiece, the interferences of the negative-angle forming portion of the rotary cam with the inner mounting surface of the workpiece and the formed negative-angle portion are prevented. Accordingly, the negative-angle portion can be formed even where the width dimension of the product is considerably small and even where the negative-angle portion is parallel to the inner mounting portion of the workpiece.

In a further preferred form of this invention, the press-forming die set further comprises a first fixed cam fixed on the first die such that the first fixed cam is rotatable about an axis of rotation thereof parallel to the press-forming direction, the first fixed cam having at one end portion thereof a first engaging surface inclined with respect to its axis of rotation, and the rotary cam has a second engaging surface which is engageable with the first engaging surface of the first fixed cam when the first and second dies are moved toward each other in the press-forming direction.

In the above preferred form of the invention, the first engaging surface of the first fixed cam is brought into engagement with the second engaging surface of the rotary cam when the first and second dies are moved toward each other in the press-forming direction. With a further movement of the first and second dies toward each other, the rotary cam is rotated by the first fixed cam, and a rotary movement of the rotary cam causes a simultaneous rotary movement of the first fixed cam so that the mutual engagement of the first and second engaging surfaces is maintained, so as to reduce or prevent the wear of these engaging surfaces due to their sliding contact. Thus, the present form of the invention assures improved durability of the rotary cam and first fixed cam.

In a still further preferred form of this invention, the die set further comprises a second fixed cam fixed on the first die such that the second fixed cam is rotatable about an axis of rotation thereof parallel to the press-forming direction, the second fixed cam having at one end portion thereof a third engaging surface inclined with respect to the axis of rotation thereof, and wherein the forming cam comprises a rotary forming cam which is provided on the second die such that the rotary forming cam is rotatable about the axis of rotation of the rotary cam, the rotary forming cam having a fourth engaging surface which is engageable with the third engaging surface of the second fixed cam when the first and second dies are moved toward each other in the press-forming direction.

In the above preferred form of the invention, the rotary forming cam is rotatable about the axis of rotation of the rotary cam, so that the die set is simplified in construction. Like the rotary cam rotated by the first fixed cam, the rotary forming cam is rotated by the second fixed cam, and a rotary movement of the rotary forming cam causes a simultaneous rotary movement of the second fixed cam so that the mutual engagement of the rotary forming cam and the second fixed cam is maintained, so as to reduce or prevent the wear of the third and fourth engaging surfaces, whereby the durability of the rotary forming cam and the second fixed cam are improved.

BRIEF DESCRIPTION OF THE INVENTION

The above and other objects, features, advantages and technical and industrial significance of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
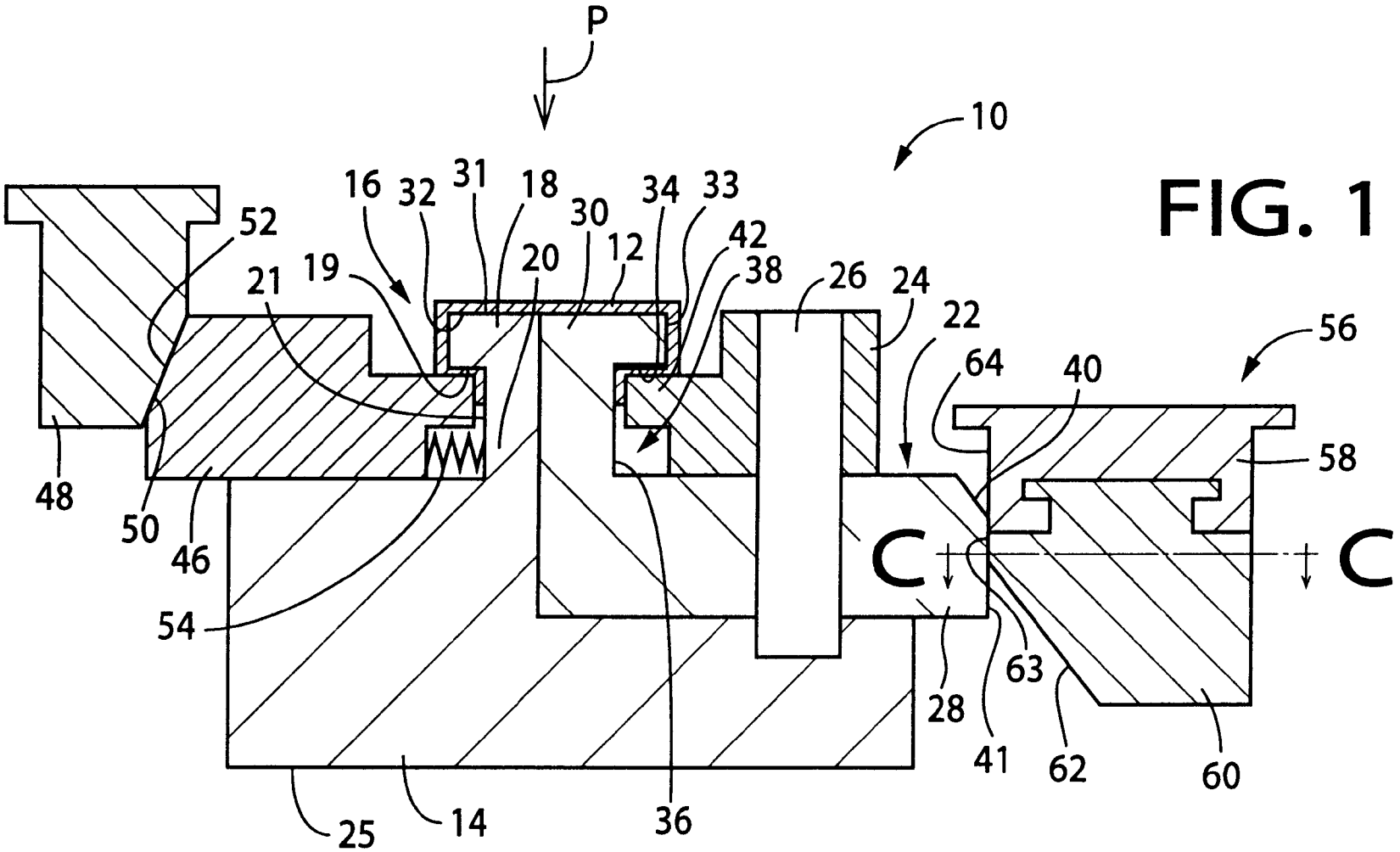
FIG. 1 is a fragmentary elevational view in cross section taken along line 1—1 of FIG. 4, showing a part of a press-forming die set constructed according to one embodiment of the present invention.

Referring first to the fragmentary cross sectional view of FIG. 1, there is shown a press-forming die set 10 including a second die in the form of a lower die 14 which is mounted on a bolster of a pressing machine such that the lower die 14 generally extends in the horizontal direction, namely, such that a bottom surface 25 of the lower die 14 extends in the horizontal direction. The die set 10 is arranged to perform a press-forming operation on a workpiece 12 in the form of a thin sheet or plate. The lower die 14 includes an upward protrusion 16 extending upright from a widthwise-central portion thereof, toward a first die in the form of an upper die not shown. The upward protrusion 16 consists of a distal portion in the form of an upper portion 18 and a proximal portion in the form of a lower portion 20 which has a smaller width than the upper portion 18. As is apparent from the following description, the upward protrusion 18 of the lower die 14 functions as a negative-angle forming portion of the lower die 14. In the present embodiment, the upper portion 18 has a shoulder surface 19, which is perpendicular to a surface 21 of the lower portion 20.

Figure 2:
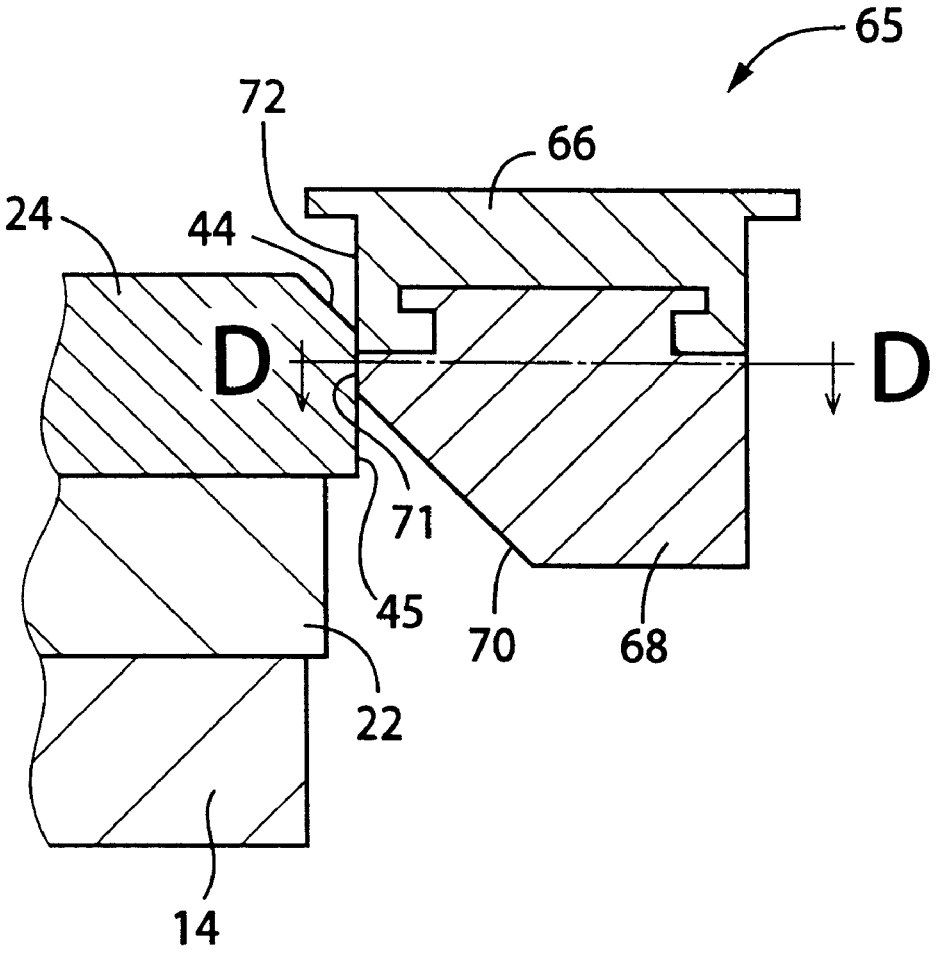
FIG. 2 is an elevational view in cross section taken along line 2—2 of FIG. 4.

On the lower die 14, there is mounted a rotary guide cam 22 on which a rotary forming cam 24 is mounted, as also shown in FIG. 2. These rotary guide cam 22 and rotary forming cam 24 are supported on the lower die 14 rotatably about a rotary shaft 26 that is perpendicular. to the above-indicated bottom surface 25 of the lower die 14. The rotary shaft 26 extends in the vertical direction, that is, in the press-forming direction in which the upper die and the lower die 14 are moved toward and away from each other when a press-forming operation is performed on the pressing machine.

Figure 3:
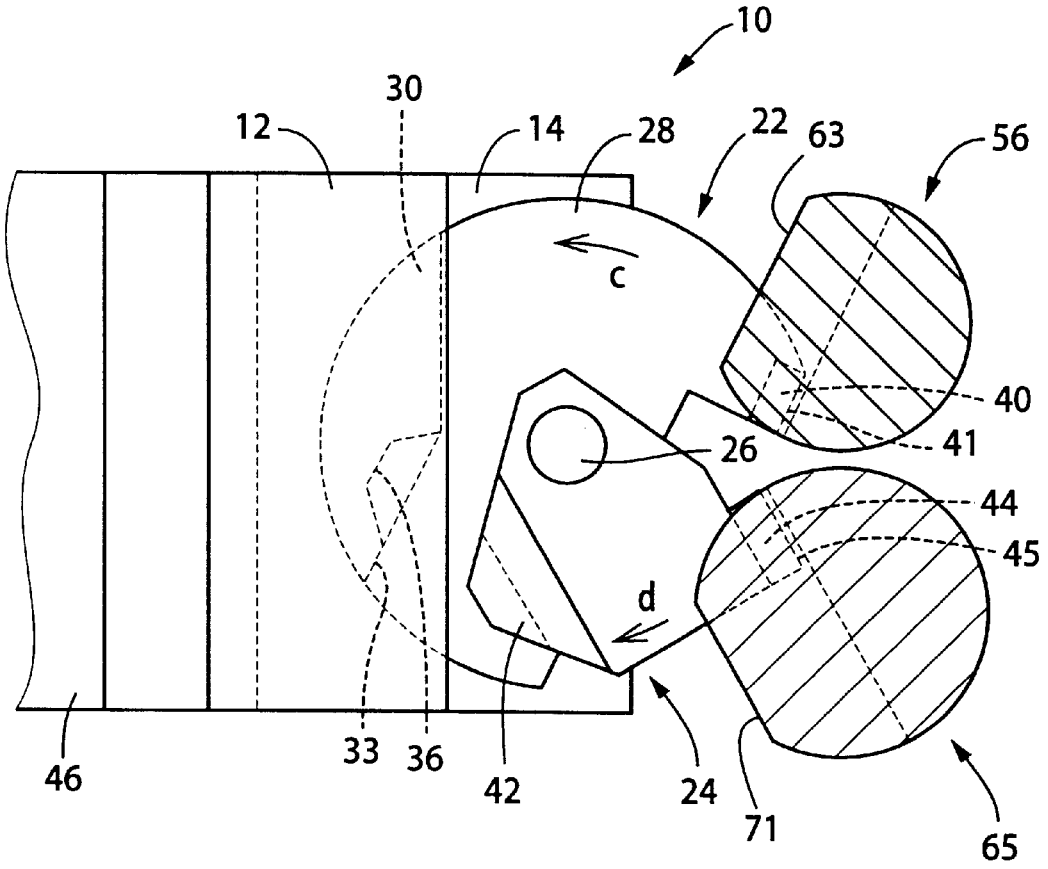
FIG. 3 is a plan view of the die set of FIG. 1 when a press-formed workpiece is removed.
Figure 4:
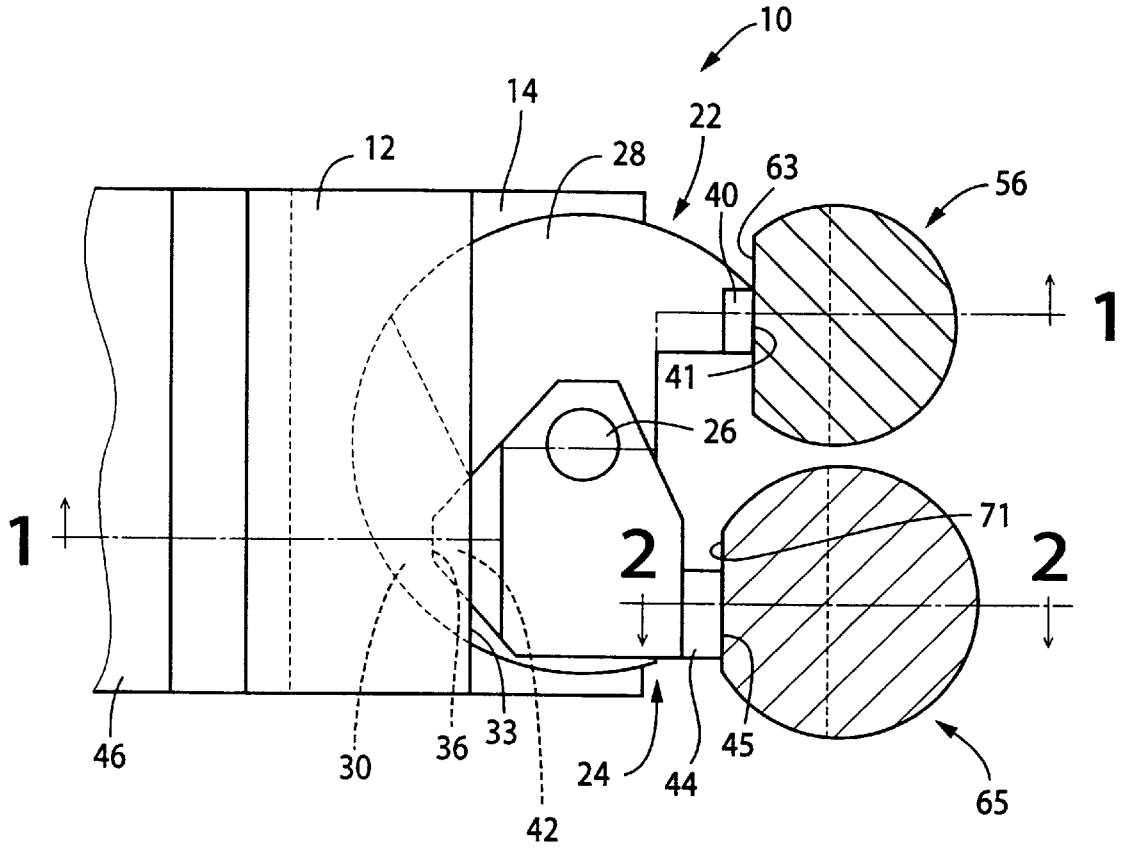
FIG. 4 is a plan a view of FIG. 1 when an upper die of the die set is located at its lower stroke end or dead point.

As also shown in the plan views of FIGS. 3 and 4, the io rotary guide cam 22 includes a base portion 28 consisting of a part of a circular disc, and a first negative-angle forming portion 30 which extends upwards from an outer peripheral part of the base portion 28. The negative-angle forming portion 30 has an upper end face which is flush with an upper end face of the upper portion 18 of the upward protrusion 16 of the lower die 14. The upper end face of the negative-angle forming portion 30 cooperates with the upper end face of the upward protrusion 16 to define an upper surface 31 of the lower die 14, as indicated in FIG. 1. Before a press-forming operation is initiated on the pressing machine equipped with the present die set 10, the workpiece 12 in the form of a thin sheet is placed on the lower die 14 such that the workpiece 12 is held at its inner mounting surface 32 with the upper surface 31 of the lower die 14.

The negative-angle forming portion 30 extending upward from the base portion 28 has an inner surface 33 having a recess 38, which is defined by a negative-angle forming surface 34 in the form of a shoulder surface perpendicular to the surface 33 and parallel to the inner mounting surface 32, and a recessed surface 36 perpendicular to the negative-angle forming surface 34. The base portion 28 has a circumferential end section having a flat slant engaging surface 40 inclined at a suitable angle with respect to the axis of the rotary shaft 26, and a vertical engaging flat surface 41 which is adjacent to the flat slant engaging surface 40 and parallel to the axis of the rotary shaft 26.

The rotary forming cam 24 includes a second negative-angle forming portion 42 engageable with the recess 38 of the first negative-angle forming portion 30 of the rotary guide cam 22. As also shown in FIGS. 2–4, the rotary forming cam 24 has a flat slant engaging surface 44 inclined at a suitable angle with the axis of the rotary shaft 26, and a flat vertical engaging surface 45 which is adjacent to the slang engaging surface 44 and parallel to the axis of the rotary shaft 26.

Referring back to FIG. 1, a linear slide cam 46 is mounted on the lower die 14, on one side of the upward protrusion 16 which is remote from the rotary guide cam 22, such that the linear slide cam 46 is movable in the horizontal direction (parallel to the inner mounting surface 32 of the workpiece 12 until one end portion of the linear slide cam 46 is brought into engagement with a recess defined by the shoulder surface 19 and the surface 21 of the protrusion 16 of the lower die 14. The linear slide cam 46 has a slant cam surface 52 engageable with a cam surface 50 of a third fixed cam 48 fixed on the upper die. The linear slide cam 46 is biased by a spring 54 in a direction away from the upward protrusion 16.

A first fixed cam 56 fixed on the upper die consists of an upper member 58 fixed on the upper die and a lower member 60 that engages the upper member 58 such that the lower member 60 is rotatable relative to the upper member 58. The upper member 58 is fixed on the upper die such that the axis of rotation of the lower member 60 is parallel to the press-forming direction. The lower member 60 has a slant engaging surface 62 that is inclined at the same angle as the slant engaging surface 40 of the rotary guide cam 22, and a vertical engaging surface 63 which is adjacent to the slant engaging surface 62 and which is parallel to the vertical engaging surface 41 of the rotary guide cam 22. The upper member 58 also has a vertical engaging surface 64 which is flush with the vertical engaging surface 63 and which is brought into engagement with the vertical engaging surface 41 when the lower member 60 is rotated by the rotary guide cam 22 by the maximum angle, that is, when the upper die has been lowered to its lower dead point or lower stroke end. The first fixed cam 56 is fixed on the upper die such that the slant engaging surface 62 or vertical engaging surface 63, 64 engages the slant engaging surface 40 or vertical engaging surface 41 of the rotary guide cam 22 while the upper die is in a lower half of its entire press-forming stroke.

Referring to FIG. 2, a second fixed cam 65 also fixed on the upper die consists of an upper member 66 and a lower member 68, which are similar to the upper and lower members 58, 60 of the first fixed cam 56. That is, the upper member 66 is fixed on the upper die such that the axis of rotation of the lower member 68 relative to the upper member 66 is parallel to the press-forming direction. The lower member 68 has a slant engaging surface 70 which is inclined at the same angle as the slant engaging surface 44 of the rotary forming cam 24, and a vertical engaging surface 71 which is adjacent to the slang engaging surface 70 and which is parallel to the vertical engaging surface 45 of the rotary forming cam 24 The upper member 66 also has a vertical engaging surface 72 which is flush with the vertical engaging surface 71 and which is brought into engagement with the vertical engaging surface 71 when the lower member 68 is rotated by the rotary forming cam 24 by the maximum angle, that is, when the upper die has been lowered to its lower dead point or lower stroke end. The second fixed cam 56 is fixed on the upper die such that the slant engaging surface 70 or vertical engaging surface 71, 72 engages the slant engaging surface 44 or vertical engaging surface 45 of the rotary forming cam 24 while the upper die is in a lower half of its entire press-forming stroke.

Referring to FIGS. 3 and 4, there will be described a press-forming operation on the workpiece 12 so as to form a negative-angle portion, using the press-forming die set 10 which is constructed as described above. In the plan view of FIGS. 3 and 4, the upper die per se is not shown, and the first fixed cam 56 is shown in cross section taken along line C—C of FIG. 1, while the second fixed cam 65 is shown in cross section taken along line D—D of FIG.2.

Before the press-forming operation is initiated, the rotary guide cam 22 and the rotary forming cam 24 are placed in their positions indicated in FIG. 3. In this state, the workpiece 12 which has been formed to have a generally C-shape in cross section (as seen in FIG. 1) in a preliminary drawing step is placed on the lower die 14 such that the inner mounting surface 32 of the workpiece 12 is held in contact with the upper surface 31 of the lower die 14. The press-forming operation with the die set 10 is initiated with a downward movement of the upper die (not shown) in the press-forming direction perpendicular to the bottom surface 25 of the lower die 14, namely, perpendicular to the inner mounting surface 32 of the workpiece 12. As the upper die is moved down, the slant engaging surface 62 of the first fixed cam 56 is brought into engagement with the slant engaging surface 40 of the rotary guide cam 22, while the slang engaging surface 70 of the second fixed cam 65 is bought into engagement with the slang engaging surface 44 of the rotary forming cam 24, and the cam surface 50 of the third fixed cam 48 is brought into engagement with the cam surface 52 of the linear slide cam 46.

Figure 5:
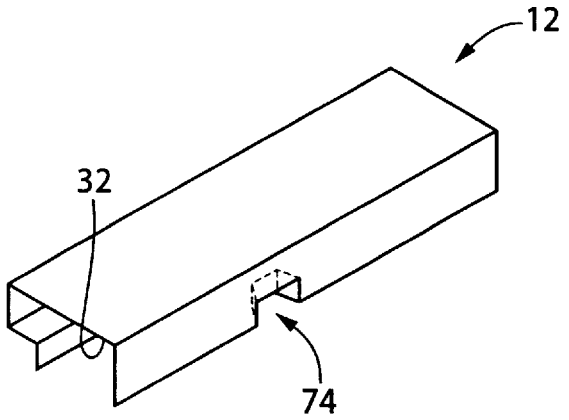
FIG. 5 is a perspective view of the workpiece as formed by the die set of FIG. 1.
Figure 6:
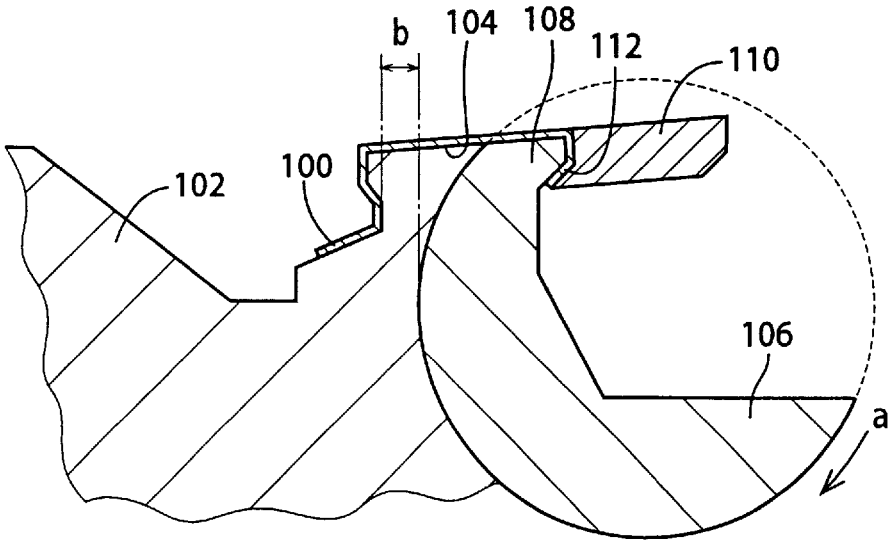
FIG. 6 PRIOR ART
FIG. 6 is a fragmentary elevational view in cross section, showing a known press-forming die set wherein a rotary cam is rotatable about an axis which is parallel to a bottom surface of a lower die.

When the upper die is moved down a further distance, a pad provided on the upper die comes into abutting contact with the upper surface of the workpiece 12, so that the portion of the workpiece 12 having the inner mounting surface 32 is pressed between the pad and the upper surface 31 of the lower die 14. During this pressing of the workpiece between the pad and the upper surface 31, a negative-angle portion 74 as shown in FIG. 5 is formed on the workpiece 12, in the following manner. That is, the rotary guide cam 22 is rotated by the first fixed cam 56 in the direction "c" indicated in FIG. 3, so that the lower member 60 of the first fixed cam 56 is rotated with its slant engaging surface 62 held in contact with the slant engaging surface 50 of the rotary guide cam 22. At the same time, the rotary forming cam 24 is rotated by the second fixed cam 65 in the direction "d" indicated in FIG. 3, so that the lower member 68 of the second fixed cam 65 is rotated with its slant engaging surface 70 held in contact with the slant engaging surface 45 of the rotary forming cam 24. As a result, the negative-angle forming portion 30 of the rotary guide cam 22 and the negative-angle forming portion 42 of the rotary forming cam 24 are brought into engagement with each other.

When the upper die has been lowered to its lower stroke end, the slant engaging surface 62 of the first fixed cam 56 and the slant engaging surface 70 of the second fixed cam 65 are disengaged from the respective slant engaging surfaces 40, 44 of the rotary guide and forming cams 22, 24, and the vertical engaging surfaces 63, 64 of the first fixed cam 56 are brought into engagement with the vertical engaging surface 41 of the rotary guide cam 22, while the vertical engaging surfaces 71, 72 of the second fixed cam 64 are brought into engagement of the vertical engaging surface 45 of the rotary forming cam 24. Thus, when the negative-angle portion as indicated at 74 in FIG. 5 is formed on the workpiece 12, the first fixed cam 56 receives a force from the rotary guide cam 22, primarily at its vertical engaging surfaces 63, 64 while the second fixed cam 65 receives a force from the rotary forming cam 24, primarily at its vertical engaging surfaces 71 72, as shown in FIGS. 1, 2 and 4. As is apparent from FIG. 5, the negative-angle portion 74 generally extends under the inner mounting surface 32 of the workpiece 12, in the direction substantially perpendicular to the press-forming direction. At the same time, another negative-angle portion is formed by a rightward movement of the linear slide cam 46 by the third fixed cam 48 against the biasing force of the spring 54, toward the negative-angle forming portion 19, 21 of the upward protrusion 16 of the lower die 14. This negative-angle portion, which is not shown in FIG. 5, is located on the side of the workpiece 12, which is opposite to the negative-angle portion 74.

After the negative-angle portions including the portion 74 have been formed, the upper die is moved to its upper stroke end. During this upward movement of the upper die, the rotary guide cam 22, the rotary forming cam 24, the first fixed cam 56 and the second fixed cam 65 are rotated in the directions opposite to those during the downward movement of the upper die. Described more specifically, the vertical engaging surfaces 63, 64 of the first fixed cam 56 are disengaged from the slant engaging surface 41 of the rotary guide cam 22, while the vertical engaging surfaces 71, 72 of the second fixed cam 65 are disengaged from the slant engaging surface 45 of the rotary forming cam 24, as the upper die is moved upwards. Then, the rotary movements of the rotary guide and forming cams 22, 24 in the directions opposite to those during the downward movement of the upper die are initiated, under the biasing action of return springs (not shown) acting on those cams 22, 24. As a result, the slant engaging surface 62 of the first fixed cam 56 is brought into engagement with the slant engaging surface 40 of the rotary guide cam 22, while the slant engaging surface 70 of the second fixed cam 65 is brought into engagement with the slant engaging surface 44 of the rotary forming cam 24.

With the upper die being further moved upwards, the lower member 60 of the first fixed cam 56 is rotated in the direction opposite to that during the downward movement of the upper die, with the slant engaging surfaces 62, 40 of the cams 56, 22 being held in engagement with each other under the biasing force of the corresponding return spring. Similarly, the lower member 68 of the second fixed cam 65 is rotated in the direction opposite to that during the downward movement of the upper die, with slang engaging surfaces 70, 44 of the cams 65, 24 being held in engagement with each other under the biasing force of the corresponding return spring.

In the press-forming die set 10 constructed as described above according to the present embodiment of the invention, the rotary shaft 26 of the rotary guide cam 22 extends in the vertical direction, perpendicularly to the bottom surface 25 of the lower die 14, so that the negative-angle forming portion 30 of the rotary guide cam 22 and the negative-angle forming portion 42 of the rotary forming cam 24 are brought into engagement with each other by the rotary movements of the rotary guide and forming cams 22, 24 about the vertical rotary shaft 26, to form the negative-angle portion 74 on the workpiece 12 placed on the lower die 14. After the negative-angle portion 74 is formed in this manner, the rotary guide cam 22 is rotated in the reverse direction. In this respect, it is significant to note that the negative-angle forming portion 30 of the rotary guide cam 22 will not at all interfere with the inner mounting surface 32 of the workpiece 32 during the rotary movement of the guide cam 22 in the reverse direction. It is further noted that the negative-angle forming portion 30 of the guide cam 22 will not interfere with the formed negative-angle portion 74 of the workpiece 12 during the reverse rotary movement of the guide cam 22. Accordingly, the rotary guide cam 22 is not required to have a large diameter for the purpose of avoiding the interference between the negative-angle forming portion 30 and the formed negative-angle portion 74. Thus, the present die set 10 permits the formation of the negative-angle portion 74 even where the width dimension of the workpiece 12 is comparatively small and the negative angle of the negative-angle portion 74 with respect to the vertical press-forming direction is comparatively large, namely, 90°.

In the present die set 10, the slant engaging surface 62 of the first fixed cam 56 comes into engagement with the slant engaging surface 40 of the rotary guide cam 22 during the downward movement of the upper die toward the lower die 14, and a further downward movement of the upper die causes the rotary guide cam 22 to be rotated by the first fixed cam 22. This rotary movement of the rotary guide cam 22 causes the concurrent rotary movement of the lower member 60 of the first fixed cam 56, so that the engagement of the slant engaging surface 62 of the first fixed cam 56 with the slant engaging surface 40 of the rotary guide cam 22 is maintained. Accordingly, the wear of the slant engaging surfaces 62, 40 which would take place due to their sliding contact is effectively prevented, leading to improved durability of the rotary guide cam 22 and the first fixed cam 56.

In the present die set 10, the rotary shaft 26 of the rotary guide cam 22 is utilized as a rotary shaft of the rotary forming cam 24, whereby the die set 10 is simplified in construction. It is further noted that the rotary forming cam 24 is rotated by the second fixed cam 65 in the same manner as described with respect to the rotary guide cam 22 rotated by the first fixed cam 56, so that the wear of the slant engaging surfaces 70, 44 of the cams 65, 24 due to their sliding contact is effectively prevented, leading to improved durability of the cams 65, 24.

While the presently preferred embodiment of this invention has been described above by reference to the accompanying drawings, by way of example only, it is to be understood that the invention may be otherwise embodied.

The die set 10 in the illustrated embodiment is adapted such that the first and second dies in the form of the upper die and the lower die 14 are moved toward and away from each other in the vertical direction. However, the die set may be adapted such that the first and second dies may be moved in the horizontal direction or any other direction inclined with respect to the vertical or horizontal direction.

In the illustrated embodiment, the rotary guide cam 22 and the rotary forming cam 24 are both provided on the second die in the form of the lower die 14, while the first fixed cam 56 and the second fixed cam 65 for rotating the respective rotary guide and forming cams 22, 24 are provided on the second die in the form of the upper die. However, the die set may be arranged such that the rotary guide and forming cams 22, 24 are provided on the upper die while the first and second fixed cams are provided on the lower die.

The illustrated embodiment is adapted such that the rotary guide cam 22 is directly rotated by the first fixed cam 56 provided on the upper die, when the upper die is lowered. However, the rotary guide cam 22 is rotated otherwise. For instance, the lower die is provided with a motion converting device adapted to generate an output force in the upward direction at one of opposite end portions thereof when an input force in the downward direction is received at the other end portion, and a lower-die fixed cam which engages the above-indicated one end portion of the motion converting device and which is moved in the vertical direction by the motion converting device. In this arrangement, the first fixed cam 56 is arranged to apply the downward input force to the above-indicated other end portion of the motion converting device, for moving the above-indicated lower-die fixed cam in the upward direction so as to rotate the rotary guide cam 22.

In the die set 10 according to the illustrated embodiment, the negative-angle forming surface 34 of the rotary guide cam 22 is parallel to the inner mounting surface 32 of the workpiece 12, so that the negative angle of the negative-angle portion 74 formed by the rotary guide and forming cams 22, 24 is 90° with respect to the vertical press-forming direction. However, the negative-angle forming surface 34 need not be parallel to the inner mounting surface 32 and perpendicular to the press-forming direction, but may be inclined by a suitable angle smaller than 90° with respect to the press-forming direction.

While the die set 10 includes the rotary forming cam 24, a slide cam may be used in place of the rotary forming cam.

In the illustrated embodiment, the workpiece 10 which has been subjected to the preliminary drawing operation is subjected to a negative-angle forming operation to form the negative-angle portions including the portion 74, the die set according to the present invention may be arranged to perform a negative-angle forming operation concurrently with a drawing operation on the workpiece in the form of a flat thin sheet or plate.

Although the rotary forming cam 24 is rotatable relative to the rotary shaft 26 in the die set 10, the cam 22 and the rotary shaft 26 may be constructed such that the cam 22 and the shaft 26 are rotated as a unit. That is, the rotary guide cam 22 is merely required to be rotated about a vertical axis.

It is to be understood that the present invention may be embodied with various other changes, modifications and improvements, which may occur to those skilled in the art, without departing from the spirit and scope of the invention defined in the following claims:

What is claimed is:

1. A press-forming die set including a first die and a second die which are linearly movable toward each other in a predetermined press-forming direction, for engagement with each other to form a negative-angle portion on a workpiece placed on said second die, said press-forming die comprising:

a rotary cam including a first negative-angle forming portion and disposed such that said rotary cam is rotatable about an axis of rotation inclined with respect to a bottom surface of said second die, said rotary cam being engageable with said second die and rotated about said axis of rotation in one of opposite directions when said first and second dies are moved toward each other in said press-forming direction, said rotary cam being rotated in the other of said opposite directions when said first and second dies are moved away from each other; and a forming cam including a second negative-angle forming portion which is held in engagement with said first negative-angle forming portion of said rotary cam while said first and second dies are held in engagement with each other, and which is disengaged from said first negative-angle forming portion when said first and second dies are spaced apart from each other.

2. A press-forming die set according to claim 1, further comprising a rotary shaft provided on said second die such that an axis of rotation of said rotary shaft is inclined with respect to said bottom surface of said second die, and wherein said rotary cam is rotatable about said axis of rotation of said rotary shaft.

3. A press-forming die set according to claim 1, wherein said axis of rotation of said rotary cam is inclined by an angle of at least 30° with respect to said bottom surface of said second die.

4. A press-forming die set according to claim 3, wherein said axis of rotation of said rotary cam is inclined by an angle of at least 60° with respect to said bottom surface of said second die.

5. A press-forming die set according to claim 4, wherein said axis of rotation of said rotary cam is inclined by an angle of at least 90° with respect to said bottom surface of said second die.

6. A press-forming die set according to claim 1, further comprising a first fixed cam fixed on said first die such that said first fixed cam is rotatable about an axis of rotation thereof parallel to said press-forming direction, said first fixed cam having at one end portion thereof a first engaging surface inclined with respect to said axis of rotation thereof, and wherein said rotary cam has a second engaging surface which is engageable with said first engaging surface of said first fixed cam when said first and second dies are moved toward each other in said press-forming direction.

7. A press-forming die set according to claim 6, wherein said first fixed cam consists of an upper member fixed on the first die and a lower member which engages said upper member such that said lower member is rotatable relative to said upper member about an axis parallel to said press-forming direction.

8. A press-forming die set according to claim 6, further comprising a second fixed cam fixed on said first die such that said second fixed cam is rotatable about an axis of rotation thereof parallel to said press-forming direction, said second fixed cam having at one end portion thereof a third engaging surface inclined with respect to said axis of rotation thereof, and wherein said forming cam comprises a rotary forming cam which is provided on said second die such that said rotary forming cam is rotatable about said axis of rotation of said rotary cam, said rotary forming cam having a fourth engaging surface which is engageable with said third engaging surface of said second fixed cam when said first and second dies are moved toward each other in said press-forming direction.

9. A press-forming die set according to claim 8, wherein said second fixed cam consists of an upper member fixed on the first die and a lower member which engages said upper member of said second fixed cam such that said lower member of said second fixed cam is rotatable relative to said upper member of said second fixed cam about an axis parallel to said press-forming direction.

* * * * *